United States Patent [19]

Alexandrovich et al.

[11] Patent Number: 4,701,387

[45] Date of Patent: Oct. 20, 1987

[54] PLURAL-STAGE LIQUID DEVELOPMENT OF ELECTROSTATIC CHARGE PATTERNS

[75] Inventors: Peter S. Alexandrovich, Rochester; Domenic Santilli, Webster; Yee S. Ng, Fairport, all of N.Y.

[73] Assignee: Eastman Kodak Company, Rochester, N.Y.

[21] Appl. No.: 886,143

[22] Filed: Jul. 16, 1986

[51] Int. Cl.[4] ..... G03G 13/10; G03G 13/22

[52] U.S. Cl. ..... 430/45; 430/54; 430/117; 430/119

[58] Field of Search ..... 430/45, 54, 117, 119

[56] References Cited

U.S. PATENT DOCUMENTS

| | | | |
|---|---|---|---|
| 3,577,259 | 5/1971 | Sato et al. | 430/119 |
| 3,692,523 | 9/1972 | Tamai et al. | 430/126 |
| 3,738,832 | 6/1973 | Matsumoto et al. | 430/42 X |
| 3,806,340 | 4/1974 | Sato et al. | 430/42 X |
| 3,971,659 | 7/1976 | Sato et al. | 430/45 |

FOREIGN PATENT DOCUMENTS

| | | | |
|---|---|---|---|
| 1930008 | 3/1970 | Fed. Rep. of Germany | 430/119 |
| 49-26902 | 7/1974 | Japan | 430/117 |
| 1278858 | 6/1972 | United Kingdom | 430/117 |

OTHER PUBLICATIONS

Research Disclosure No. 12060, *Research Disclosure*, Apr. 1974, Kenneth Mason Publications Ltd., Hampshire, England.

*Primary Examiner*—Roland E. Martin

*Attorney, Agent, or Firm*—Robert A. Gerlach

[57] ABSTRACT

In plural-stage liquid development of electrostatic charge patterns, as in multicolor electro-photography, image defects occur in areas of the image which are undeveloped or background areas of a previous development stage. The method of the invention avoids such defects by rinsing the image with a polar liquid between development stages to remove counterions which are believed to cause the defects.

9 Claims, 9 Drawing Figures

PLURAL-STAGE LIQUID DEVELOPMENT OF ELECTROSTATIC CHARGE PATTERNS

FIELD OF THE INVENTION

This invention relates to the liquid development of electrostatic charge patterns, and more particularly to an improved method of plural-stage electrophoretic liquid development.

BACKGROUND

In the liquid development of electrostatic-charge latent images, as in electrophotography, a substrate having a charge pattern on its surface is contacted with a liquid developer which is a suspension of colloidal toner particles in an insulating carrier liquid. The developer normally also contains a charge-control agent. The latter is an ionic compound which controls the magnitude of the charge on the toner particles and aids in maintaining a stable charge on the toner particles within the insulating carrier liquid. It may also contain an ionic dispersion stabilizer which aids in maintaining the colloidal toner particles in suspension, or a single appropriate compound may function as a charge-control agent and stabilizer.

Liquid development is used for single-stage development of electrostatic-charge patterns. It can also be used, however, in plural-stage development, for instance, in the sequential development of two or more color-separation images, or in the annotation of a developed image or in the repeated development of images on a reusable photoconductor after transfer of a developed image.

In certain plural-stage liquid development processes, a problem has arisen. The problem is especially significant in processes for the electrophotographic reproduction of multicolor images of graphic-arts quality. These processes involve exposing a photoconductor sequentially through a series of four registered color-separation transparencies with liquid development of each latent image before the next is formed. The problem is that image defects may occur when developing areas of the substrate which are background or untoned areas of a previous stage. The defect appears as a runny or smeared image in the previously untoned areas, a defect not acceptable for producing high-quality images as required in graphic arts.

It has been discovered that the described image defects in plural-stage liquid development are caused by forces or substances in the previously untoned areas which interfere with further development in those areas. Although the exact nature of those forces or substances is not certain, the present invention provides a method which reduces or eliminates the problem.

SUMMARY OF THE INVENTION

The method of the invention comprises forming an electrostatic-charge pattern on an insulating surface of an electrostatic recording element, developing the latent image with a liquid developer composition comprising an insulating carrier liquid, a toner and an ionic charge-control agent, rinsing the developed surface with a polar rinse liquid which is not a solvent for the toner, thereafter forming a second charge pattern on the surface extending into areas of the surface not previously developed with toner, and developing the second charge pattern with a liquid developer.

In a preferred embodiment especially adapted for use when the charge-control agent of the developer is a polymeric organo-lithium compound, the polar rinse liquid contains as a carrier liquid a volatile paraffinic hydrocarbon and, as a polar component, oleic acid, linoleic acid or a naphthenic acid in a concentration from 0.5 to 3.5 weight percent.

THE DRAWINGS

The invention will be described by reference to the drawings, of which:

DETAILED DESCRIPTION OF THE INVENTION

Figure 1:
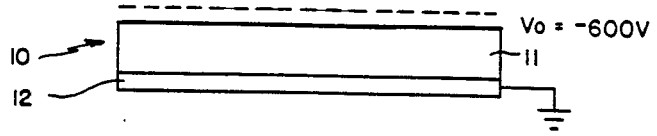
FIG. 1 is a diagrammatic sectional view of an electrostatically charged electrophotographic element with which the method of the invention can be used.

The method of the present invention is useful in any electrostatic recording process wherein a charge pattern is formed and developed with a liquid developer on a surface which has previously been developed with a liquid developer. Examples of such electrostatic recording processes include not only electrophotography, but also processes which do not require light exposure such as dielectric recording, electrostatic recording, computer-graphics output recording and the like. In such processes, an electrostatic charge pattern is fomred on an insulating surface of an electrostatic recording element such as a photoconductive element or a nonphotoconductive dielectric element. It is particularly useful, however, in combination with a recently developed electrophotographic method of making graphic-arts color proofs. This new method is described in the copending U.S. patent application of Ng et al, Ser. No. 773,528 filed Sept. 6, 1985. In the latter method, a photoconductor which has a thin transparent dielectric overlayer repeatedly is charged uniformly and then exposed through a series of registered color-separation transparencies. After each charge-exposure cycle, the dielectric layer is developed with a liquid developer and the surface is again uniformly charged and exposed. The sequence is repeated for each of the color transparencies, usually four, using developers of different color, e.g., cyan, magenta, yellow and black, for each cycle.

Also, after each development step and before the next developer is applied, the developed image is rinsed with an inert hydrocarbon liquid such as the developer carrier liquid to remove unwanted toner from background areas. After rinsing, the rinse liquid is removed from the photoconductive element by drying, wiping or other method to prepare for the next charge-exposure-development cycle. Rinsing with developer carrier liquid or with other nonpolar liquid which is compatible with the carrier liquid and is not a solvent for the toner is useful for removing unwanted toner from backgrounds from one development step before the next developer is applied. It does not, however, prevent image defects in the background areas of a previous development step. It has been discovered in accordance with the present invention that, when the image is rinsed after each development step with a nonsolvent polar liquid, such as a carrier liquid, which contains a minor amount of a miscible polar liquid, the smeared image defect is prevented or reduced.

Although we do not wish to be bound by any theoretical mechanism of the invention, a possible explanation for the results obtained in the method of the invention is that the rinsing of the developed substrate or photoconductor with a polar liquid neutralizes or removes from untoned areas of the substrate a deposit of counterions which interfere with development of subsequent toner deposits.

These counterions are believed to originate from an ionic charge-control agent or dispersion stabilizer in the liquid developer. They are opposite in charge to the toner particles and deposit in the untoned or nonimage areas of the substrate. When, in the next stage, toner is applied to charge patterns in those areas, the toner is initially attracted to them. Within a short time, however, a running or smearing of the toned image in such areas occurs. A possible explanation is that the toner particle is attracted to and combines with the counterion. The resulting neutral combination is no longer attracted to the charged surface and migrates - thus causing the runny or smeared image.

Another observed fact related to the counterion problem is that, when using a fresh nonpolar rinse liquid and when an appropriate bias voltage is applied at the rinse station to attract counterions away from the photoconductive element, the image defect is minimal even though no polar rinse is used. However, as the nonpolar rinse liquid is recycled, the smeared image defect in previous background areas appears. Evidently, contaminants based on the toner charge-control agent build up in the recycled rinse liquid and deposit in the background areas of the image.

The method of the invention can be used in pos—pos electrophotographic imaging where a positive electrophotographic image is made from a positive original. It is equally useful in neg/pos imaging where a positive image is made from a negative original.

The method will be described further by reference to the drawings which show diagrammatically a series of steps in the pos—pos mode.

Figure 2:
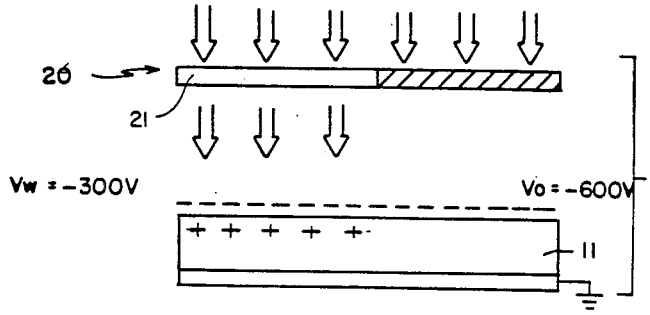
FIG. 2 shows imagewise exposure of the element to light.

As shown in FIG. 1, a photoconductive element 10 comprising a photoconductive layer 11 and a grounded conductive support 12 is charged in the dark to a negative potential of 600 volts (referred to as $V_o$) by a corona charger or other primary charging means not shown in the drawings. Then, as shown in FIG. 2, the uniformly charged element 10 is subjected to imagewise exposure through a photographic transparency 20. Light passing through the background area 21 of the transparency exposes a corresponding area of the negatively charged photoconductive layer 11, resulting in the generation of positive holes in that area of the photoconductor, and reducing the potential in that area to −300 volts. Being in the background or white area of the image, the reduced voltage is designated as $V_{white}$ or, more conveniently, Vhd w.

Figure 3:
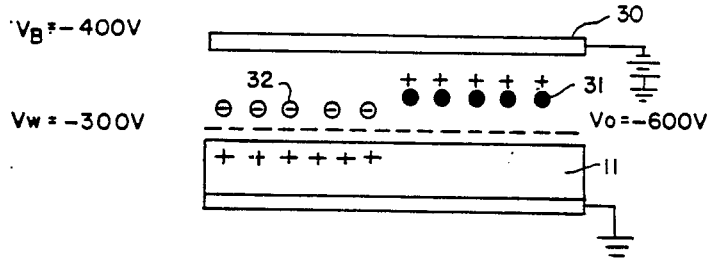
FIG. 3 shows development of an electrophotographic image on the element.

Next, as shown in FIG. 3, the exposed photoconductive element is contacted with a liquid developer in the presence of a development electrode 30 having a bias of −400 volts which is referred to as $V_{bias}$ or $V_B$.

The developer comprises a colloidal suspension of positively charged toner particles in an insulating carrier liquid such as a volatile isoparaffinic hydrocarbon which also contains a soluble ionic charge-control agent and, preferably, also an ionic dispersion stabilizer. As FIG. 3 shows, the positively charged toner particles 31 under the influence of the field between the development electrode 30 at −400 v. and the unexposed are of photoconductor 11 which is still at approximately $V_o$ of −600 v., move electrophoretically to that area of the photoconductor.

At the same time, according to what is believed to be the mechanism, negatively charged counterions 32 derived from the charge-control agent and dispersion stabilizer move under the influence of the field between the $V_b$ voltage of −400 v to the less negative exposed area of photoconductor 11.

Figure 4:
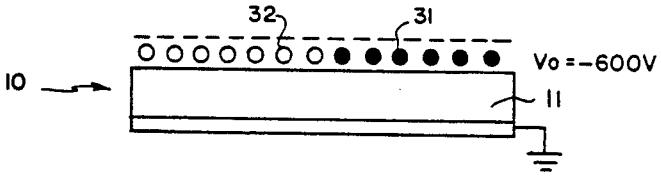
FIG. 4 shows the developed element after it is recharged for another exposure.
Figure 5:
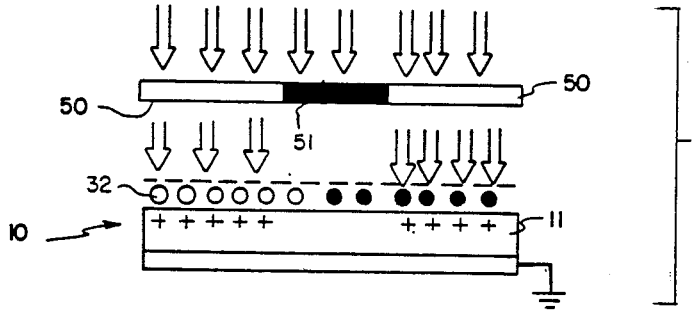
FIG. 5 shows a second exposure of the previously developed element.

FIG. 4 illustrates a second-stage charging of the previously developed photoconductive element. In this second or add-on stage, the previously developed element 10 having pigmented toner particles 31 in the previously unexposed areas and colorless counterion particles 32 in the previously exposed areas is again charged in the dark to a $V_o$ of −600 v. Following this, as shown in FIG. 5, the charged element is exposed through a second color-separation transparency having background areas 50 and an image area 51 which overlaps part of the previously exposed and untoned area of the photoconductor where counterions 32 are deposited.

Figure 6:
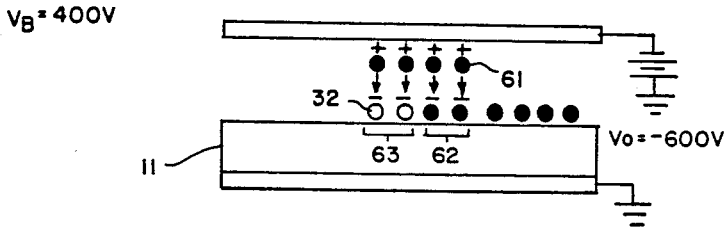
FIG. 6 shows development of the second-stage image without removal of counterions.

Next, as shown in FIG. 6, the second-stage image is developed with a second liquid developer. Toner particles 61 deposit in the unexposed area, thus adding toner in a portion 62 of the previously developed area and introducing the toner for the first time to the previously untoned area 63. Unfortunately, the latter area contains counterions 32 from the first development stage. These neutralize the toner particles, which thereafter are not electrostatically attracted to the photoconductive surface and migrate from the image area, causing an image defect.

Figure 7:
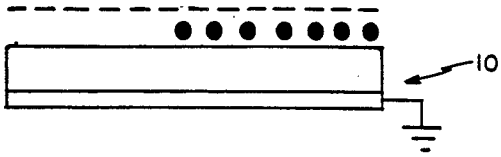
FIG. 7 shows the element after a first-stage development and after rinsing in accordance with the invention.

FIG. 7 illustrates the appearance of the photoconductive element after it has been rinsed with a polar liquid, in accordance with the present invention, and recharged following the first development stage of FIG. 3. As shown in FIG. 7, the counterions have been removed by the rinsing step.

Although the step is not illustrated in the drawings, after rinsing with the polar liquid, the polar rinse liquid preferably is removed from the surface of the photoconductive element or other chargeable element by drying, wiping or rinsing with a volatile nonpolar liquid to prepare for the next cycle. Since drying is an effective method of removal, it is preferred that the polar rinse liquid and the nonpolar rinse liquid, if one is used, be sufficiently volatile to evaporate readily. A non-polar volatile liquid such as Isopar G liquid (a product of Exxon Corporation identified as being a mixture of isoparaffins having a boiling range from about 145 ° to 185° C.) is very satisfactory as the carrier or solvent for the polar component of the polar rinse liquid.

Figure 8:
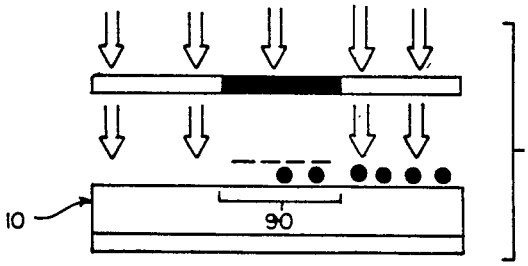
FIG. 8 illustrates exposure.
Figure 9:
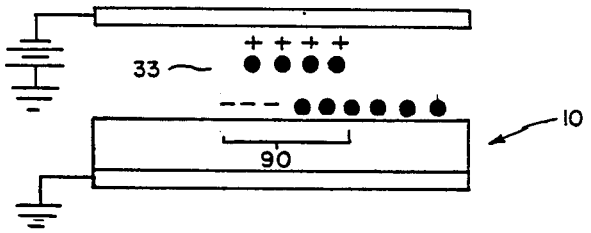
FIG. 9 illustrates development after rinsing the element with a polar liquid in accordance with the invention.

FIG. 8 illustrates exposure and FIG. 9 illustrates development of the element after rinsing with a polar liquid to remove counterions. As shown in FIG. 9, toner particles 33 are attracted to the area 90 of element 10 which was unexposed in the second exposure stage. Because the counterions were removed in the polar liquid rinse, the positively charged toner remains attracted to the element in the previously untoned area. The toner can then either be fixed to the photoconductor or transferred to a receiver surface for fixing. Of course, before fixing or transfer, any third, fourth or subsequent stages necessary for full development of the image, as in a multicolor image, are carried out.

In referring to the drawings, exposure from the frot of the film has been described. The method of the invention also applies to imaging processes in which exposure is from the back (i.e., the conductive support side) of the film, the latter being transparent to the exposing radiation.

Oleic acid is especially effective as the polar component of the polar rinse liquid when the counterion problem results from the use of a developer containing certain ionic metal-containing polymeric compounds which are included in the developer as charge-control agents or dispersion stabilizers. Examples of the latter include poly(t-butylstyrene-co-lithium methacrylate), and poly(t-butyl styrene-co-styrene-co-lithium sulfoethyl methacrylate). It is believed that the counterions derive from such charge agents and stabilizers.

Although the mechanism of removing counterions by the polar rinse procedure is not fully understood, it appears that the counterions are both neutralized and solvated and thus are removed from the photoconductor by the polar rinse. The solvation effect of oleic acid on organo-metallic charge agents can be demonstrated. A hazy solution of 0.5% poly(t-butylstyrene-co-lithium methacrylate) in Isopar G liquid clarifies when 1% oleic acid is added to the solution. Other polar liquids give a similar result.

The polar liquid used for removing and/or neutralizing counterions in the method of the invention can be a single liquid such as an alcohol, including glycols such as ethylene glycol, or water. Preferably it is a mixture of an inert carrier liquid and a polar liquid. Mixtures of polar liquids can also be used. As previously mentioned, one suitable carrier liquid is a volatile hydrocarbon liquid. The main requirements for the carrier liquid are that it be compatible with the polar component and not be a solvent for the toner or for the surface layer of the recording element since, of course, it is not desired to wash away the developed image or damage the element.

Especially preferred as polar components of the rinse liquid when the carrier liquid is a volatile hydrocarbon liquid are olefinically unsaturated carboxylic acids which are miscible with the carrier liquid, such as oleic acid, linoleic acid and naphthenic acids.

Preferably, the carrier liquid of the polar rinse liquid is volatile at room temperatures, i.e., 20° C., so that it can be removed from the imaging surface by evaporation. Nonvolatile polar rinse liquids can be used, however, if they are removable by wiping or other means. Examples of preferred carrier liquids include Isopar G liquid, as previously mentioned, other isoparaffins, cycloparaffins such as cyclohexane, normal paraffins such as n-octane, aromatics such as xylene and toluene, various mixtures of hydrocarbons such as mineral spirits, and volatile halogenated hydrocarbons such as trichloromonofluoromethane and trichlorotrifluoroethane. In referring to the preferred carrier liquids as being volatile, it is meant that substantially all of the liquid will evaporate within sixty seconds at atmospheric pressure and 20° C.

While oleic and linoleic acids are preferred polar components of the rinse liquid, many other polar liquids are suitable when the liquid developer contains polymeric organo-metallic ionic charge agents. Examples include naphthenic acid (or hexahydrdobenzoic acid) and substituted naphthenic acids. Other preferred polar liquids are methanol and ethanol.

Suitable concentrations of polar components in the rinse liquid can be determined by routine tests of any given composition. For rinse liquids composed of oleic acid, linoleic or naphthenic acids in a hydrocarbon carrier, it has been found that concentrations of from 0.5 to 3.5 weight percent of the polar component are useful and that concentrations from 0.7 to 2 weight percent give the best results. Since the polar component is used in such a low concentration, it is not essential that it by itself be a nonsolvent for the toner or the recording surface. However, the carrier liquid, as previously mentioned, and in fact the total rinse liquid containing the polar component should be a nonsolvent for the toner and the recording surface.

The following example illustrates the method of the invention with three different polar liquids and compares the method of the invention with a control.

EXAMPLE

A series of tests were made in which a photoconductive surface was charged, exposed and developed with a liqud developer and again charged, exposed and developed in previously untoned areas of the photoconductive surface. After each first development stage the surface was rinsed with a selected rinse liquid before the second exposure and development stage. In each test the liquid developer was prepared by blending 2 parts by weight of polyester binder, poly[2,2-dimethyl-1,3-propylene-4-methyl-4-cyclohexene-1,2-dicarboxylate-co-terephthalate-co-5-sodioisophthalate] 53/43/4, with one part by weight of a metallized monoazo red dye, 0.5 part of polyolefin wax and 0.5 part of poly(ethylene-co-vinyl acetate). This combination of materials was blended to form a toner. A developer concentrate was then made by dispersing the toner, a polymeric ionic charge-control agent and a polymeric ionic dispersion stabilizer at ratios of 1/0.1/0.5 by weight in Isopar G carrier liquid at a concentration of 20 weight percent solids. The developer concentrate was then diluted with Isopar G carrier liquid to obtain a working developer containing 2.0 g/liter of dry toner.

The ionic polymeric charge control agent for the developer was poly(t-butylstyrene-co-lithium methacrylate) (97/3 mole ratio) and the ionic polymeric dispersion stabilizer was poly(t-butylstryene-co-styrene-co-lithium sulfoethyl methacrylate) (72/24/4 mole ratio). Images were made on a homogeneous single-layer organic photoconductor film by charging to +500 v., exposing and developing with the above-described liquid developer, using an apparatus of the kind described in the patent to York et al, U.S. Pat. No. 3,407,786, the developer apparatus being electrically biased at +400 v. After rinsing the first-stage image at a nonbiased rinse station, the photoconductor was charged, exposed and developed in a second stage. The results of these tests, in terms of maximum desity (Dmax) of each image, and the composition of the rinse liquid for each test were as follows:

| Test | First Image Rinse Liquid | First Image Dmax | Second Image Dmax |
|---|---|---|---|
| A | Isopar G | 0.96 | 0.25 |
| B | Water | 1.02 | 0.95 |
| C | Isopar G plus 1% oleic acid | 0.99 | 1.05 |
| D | Isopar G plus 1% naphthenic acid | 0.95 | 0.89 |

The results of Test A show a low second stage image density (Dmax=0.25) when the first-stage image was washed with the hydrocarbon rinse liquid (Isopar G) which contained no polar component. The other tests all used a polar liquid rinse, which was water in Test B and Isopar G containing 1% oleic acid or naphthenic acid in Tests C and D. The density of the second-stage image in each of these tests remained high.

The example above demonstrates an embodiment of the invention in which the image quality in second and subsequent development stages is improved by using a nonbiased polar liquid rinse. It is also possible in accordance with the invention to apply an appropriate bias voltage to the rinsing apparatus sufficient to aid in avoiding counterion deposits. This combined use of polar rinse and electrical bias can be useful in minimizing the undesired deposit of counterions.

While the example demonstrates the practice of the invention in plural-stage imaging on a photoconductive element, the method is useful with a wide range of electrostatic recording elements whether they are photoconductors or nonphotoconductive dielectric recording surfaces for receiving charge patterns. Especially appropriate are organic photoconductors of the kind described in U.S. patent application Ser. No. 686,509 files Dec. 26, 1984.

The method of the present invention is effective with a wide range of liquid developers containing, in addition to the toner particles, oppositely charged ionic components such as charge-control agents or dispersion stabilizers which deposit counterions in the background areas of a developed image. The example above illustrates the use of one specific developer composition but many others are possible, such as those disclosed in the patent to Chechak, U.S. Pat. No. 3,779,924, the patent to Stahly et al, U.S. Pat. No. 3,788,995, the patent to Stahly et al, U.S. Pat. No. 3,849,165, the patent to Merrill et al U.S. Pat. No. 4,252,921, and the self-fixing, wax-containing compositions disclosed in European Patent Application Publication No. 098,084 published Jan. 11, 1984. Such liquid developers contain an electrically insulating carrier liquid and dispersed toner particles composed of a binder resin such as a polyester or a styrene-acrylic copolymer, a colorant which can be any of a wide range of organic or inorganic pigments or dyes and, optionally, a wax to render the developer self-fixing, along with a charge-control agent and a dispersion stabilizer, as previously mentioned.

The invention has been described with reference to certain preferred embodiments, but it will be understood that variations and modifications can be made within the spirit and scope of the invention.

What is claimed is:

1. The method of plural-stage liquid development of electrostatic charge patterns which comprises forming an electrostastic charge pattern on an insulating surface of an electrostatic recording element, developing the charge pattern with a liquid developer comprising an insulating carrier liquid, a toner and an ionic charge-control agent, rinsing the developed surface of the element with a polar rinse liquid which is not a solvent for the toner or for the surface of the recording element, forming a second electrostatic charge pattern on the element which extends into areas of the surface not previously developed with toner, and developing the second charge pattern with a liquid developer.

2. The method of claim 1 wherein the polar rinse liquid contains a compound selected from the group consisting of oleic acid, linoleic acid and naphthenic acid.

3. The method of claim 1 which comprises uniformly charging an insulating surface of a photoconductive element, exposing the surface to a pattern of actinic radiation to form a latent electrostatic image, developing the latent image with a liquid developer comprising an insulating carrier liquid, a toner and an ionic charge-control agent, rinsing the developed surface of the polar rinse liquid which is not a solvent for the toner or for the surface of the photoconductive element, thereafter again charging the surface of the photoconductive element, again exposing the element to a pattern of actinic radiation to form a second latent electrostatic image which extends into areas of the surface not previously developed with toner, and developing the second latent image with a liquid developer.

4. The method of claim 3 wherein the toners in the different developers are of different colors and wherein the polar rinse liquid comprises a volatile hydrocarbon liquid and, as a polar component, a carboxylic acid.

5. The method of claim 4, wherein the polar component is oleic acid, linoleic acid or a naphthenic acid in a concentration from 0.5 to 3.5 weight percent of the polar rinse liquid.

6. The method of claim 5, wherein the charge-control agent of the developer is a polymeric organo-lithium compound.

7. The method of claim 5 wherein the polar rinse liquid consists essentially of a paraffinic hydrocarbon liquid and from 0.7 to 2 weight percent oleic acid, linoleic acid or naphthenic acid.

8. The method of claim 4 wherein the surface of the photoconductive element is dried after rinsing with the polar rinse liquid and before the next development step.

9. The method of claim 1 wherein an electrical bias sufficient to aid in avoiding counterion deposits is applied while rinsing the element with a polar rinse liquid.

* * * * *